United States Patent [19]

Whipps et al.

[11] 4,226,553

[45] Oct. 7, 1980

[54] SLIDE GATES FOR WATER AND SEWAGE TREATMENT PLANTS

[75] Inventors: George E. Whipps, Athol; Richard J. Bargeron, Buckland, both of Mass.

[73] Assignee: Whipps, Inc., Athol, Mass.

[21] Appl. No.: 14,730

[22] Filed: Feb. 23, 1979

[51] Int. Cl.[2] ..... E02B 7/36

[52] U.S. Cl. ..... 405/106; 251/328

[58] Field of Search ..... 405/87, 103, 104, 105, 405/106; 251/172, 326, 328

[56] References Cited

U.S. PATENT DOCUMENTS

| | | | |
|---|---|---|---|
| 2,889,684 | 6/1959 | Abrahams | 405/106 |
| 3,326,002 | 6/1967 | Halpenny | 405/106 X |
| 3,333,816 | 8/1967 | Williams et al. | 251/328 X |
| 3,760,593 | 9/1973 | Whipps | 405/106 |
| 4,028,896 | 6/1977 | Whipps | 405/104 |

*Primary Examiner*—David H. Corbin

*Attorney, Agent, or Firm*—Schiller & Pandiscio

[57] ABSTRACT

A slide gate mechanism embodying novel seal means for providing a watertight seal between a sliding gate member and its supporting members.

12 Claims, 9 Drawing Figures

SLIDE GATES FOR WATER AND SEWAGE TREATMENT PLANTS

BACKGROUND OF THE INVENTION

This invention relates to gate mechanisms in general, and more particularly to an improved type of slide gate for regulating fluid flow.

Slide gates are not new in the art. Such gates are typically employed to regulate fluid flow through a passageway or channel and generally comprise a frame assembly which defines an opening, a gate member mounted to the frame assembly and adapted for movement therein so as to selectively open up or close off the opening in the frame assembly, some form of sealing means for assuring a watertight seal between the gate to close off the opening in the frame assembly, and operating means for urging the gate member to move within the frame assembly. The frame assembly of the slide gate is generally mounted to the walls defining the passageway or channel through which the fluid flows in such a way that substantially all of the fluid flow must pass through the opening in the frame assembly. In this way a slide gate is formed which allows one to regulate the fluid flow passing through the slide gate by controlling the position of the gate member within the frame assembly. Typical slide gates are described and illustrated in my U.S. Pat. No. 3,760,593 and the references cited therein. Other forms of gates are disclosed in my U.S. Pat. No. 4,028,896 and the references cited therein.

Unfortunately, there have been a number of problems associated with the sealing means used to ensure a watertight seal between the gate member and the frame assembly. The most common type of seal presently in use is the resilient bulb seal, generally known as the P-type or J-type seal. Slide gates with P and J-type seals are made, for example, by Coldwell Wilcox Co. of Fairfield, Connecticut and Rodney Hunt Co. of Orange, Massachusetts. This type of seal comprises a flat elongated body having an enlarged hollow or solid bulb at one end, and is designed to be positioned with its flat body mounted to the frame assembly and its enlarged bulb compressed between the movable gate member and a part of the frame assembly. The compressed bulb fills the region between the gate member and the adjacent part of the frame assembly so that a watertight seal is provided therebetween, while allowing movement of the gate member relative to the frame assembly. Alternately, the compressed bulb seal is sometimes positioned between the gate member and the wall defining the passageway or channel. In either case, in practice the compressed bulb design has exhibited a tendency to bind movement of the gate member within the frame through excessive friction therewith, so that as a result stronger operating means are required for opening and closing the gate member and the seal lifetime is decreased. In addition, the bulb portion of the seal exhibits a tendency to dam fluid (and any debris carried by the fluid) about the seal so as to impede fluid flow through the slide gate when the gate member is not closing off the opening in the frame. Bulb type seals also require separate seal retainers at the sides of the gate which are expensive, complicate installation and repair, and tend to make it difficult to predict the amount of drag on the gate.

Alternative seal designs which do not use a compressed bulb concept have exhibited similar or worse problems, such as failing to make a tight seal, having a short lifetime or having a high manufacturing or installation cost.

As a result the primary object of the present invention is to provide a slide gate which utilizes novel sealing means that substantially eliminate or reduce the aforementioned problems.

SUMMARY OF THE PRESENT INVENTION

This and other objects of the present invention are addressed by providing a slide gate mechanism comprising a frame assembly which defines an opening through which fluid flow is directed, a gate member mounted to the frame assembly and adapted for relative vertical movement so as to selectively open up or close off the opening in the frame assembly, operating means carried by the frame assembly for causing the gate member to move relative to the frame assembly, and improved sealing means mounted to the frame assembly for assuring a watertight seal between the gate member and the frame assembly when the gate member is positioned to close off the opening in the frame assembly. The improved sealing means comprises a sealing member having an offset bulb portion and a simple and versatile means for mounting the sealing member to the frame assembly.

THE DRAWINGS

Still other objects and advantages of the present invention will become apparent in the following detailed description of the invention, which is to be considered together with the accompanying drawings wherein like numbers refer to like parts and further wherein.

Figure 1:
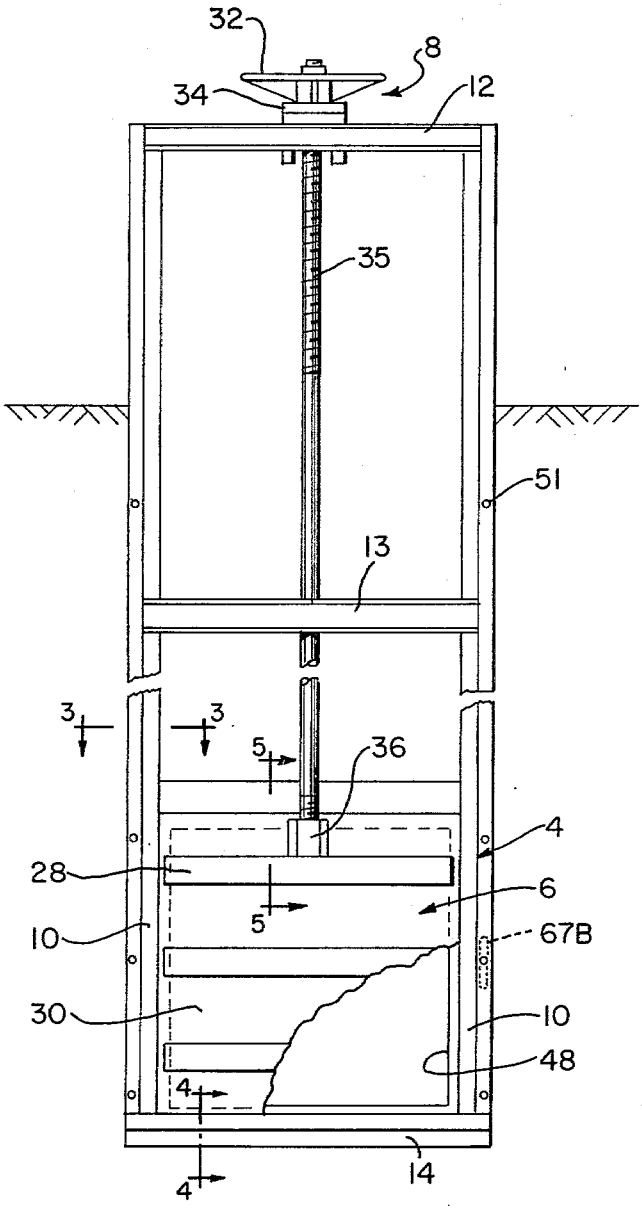
FIG. 1 is a front view in elevation showing the preferred form of the present invention in an upwardly opening gate mechanism.
Figure 3:
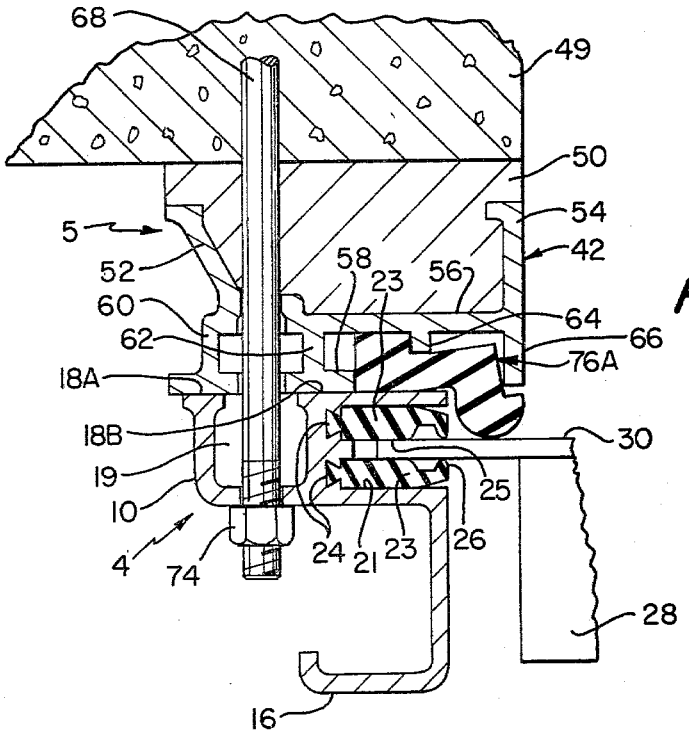
Figure 4:
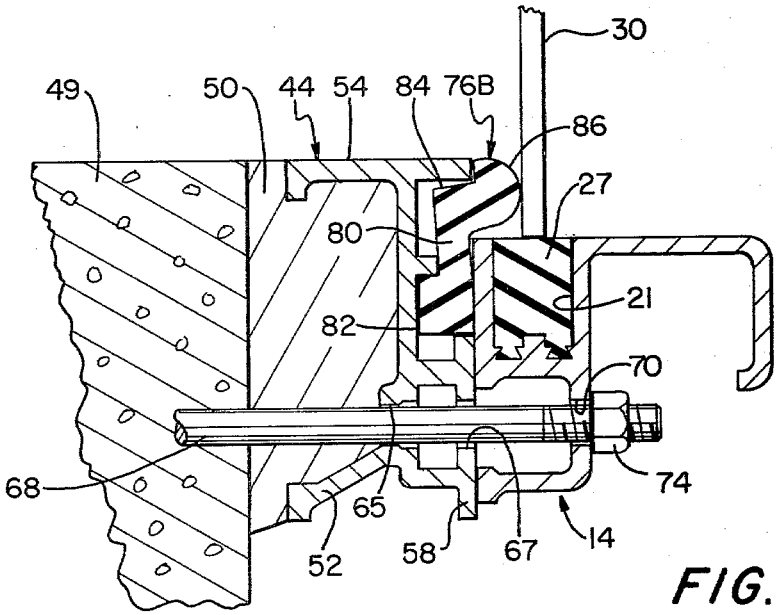
Figure 5:
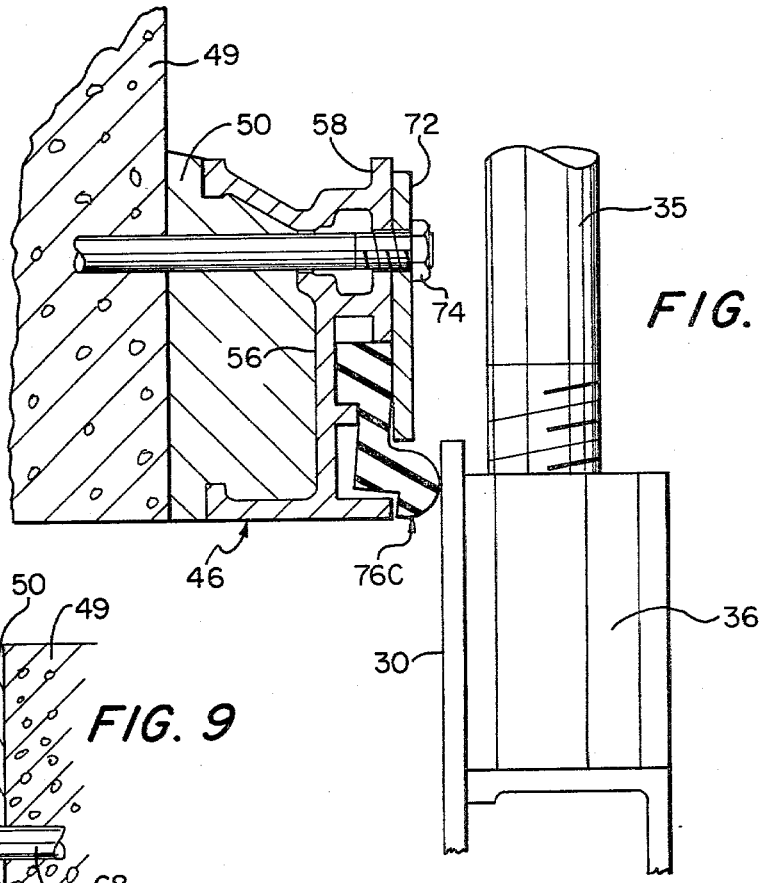
Figure 9:
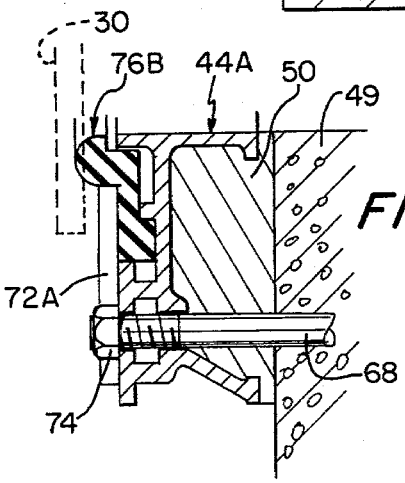
Figure 6:
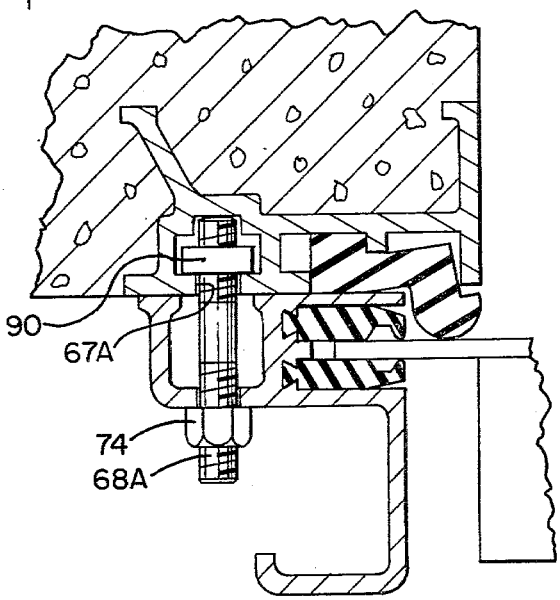
Figure 7:
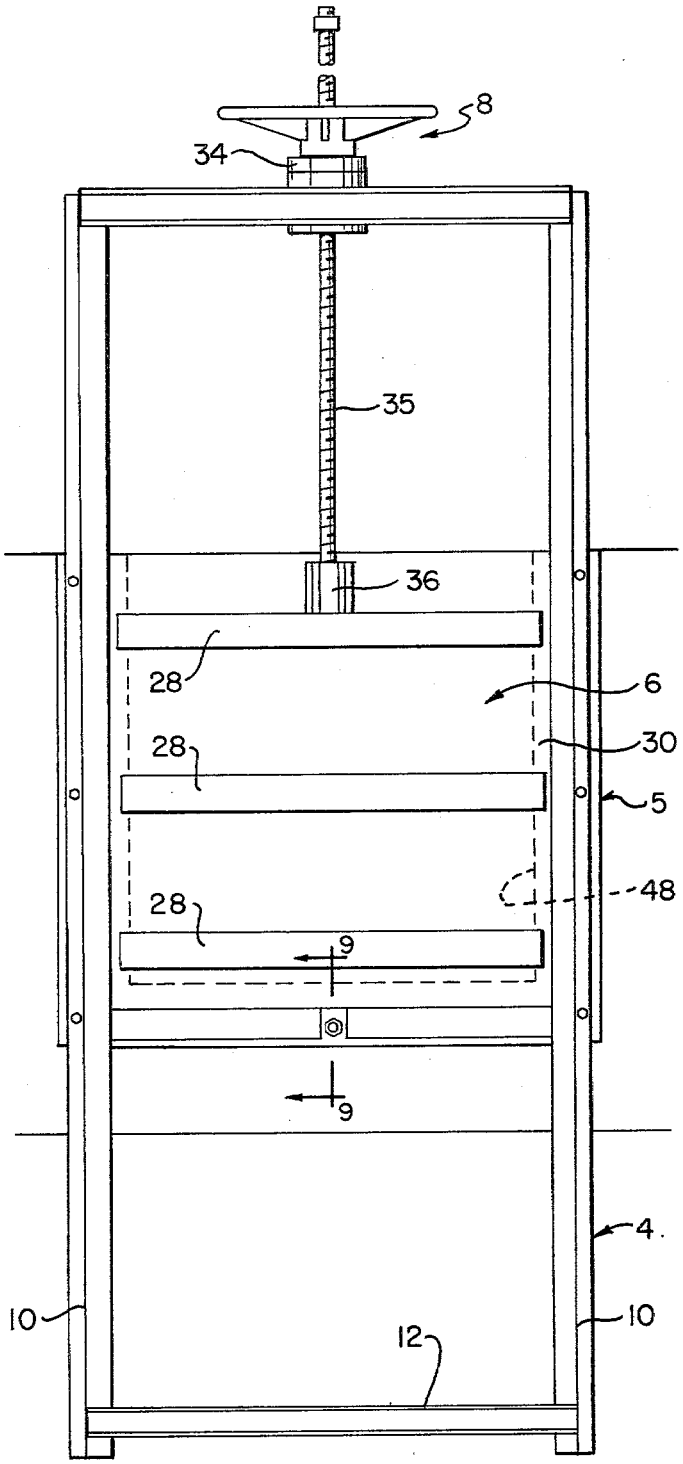
Figure 8:
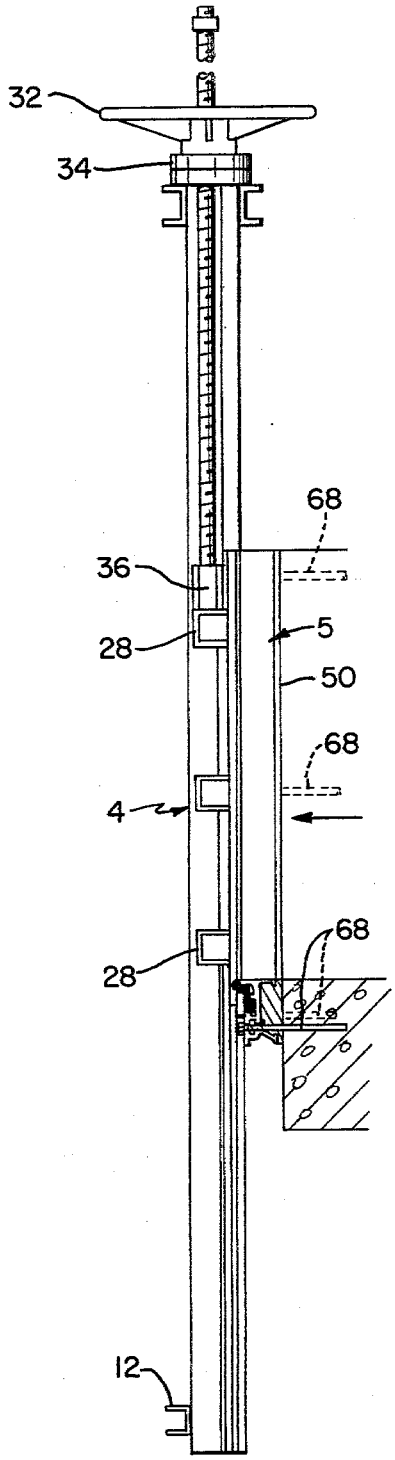

FIGS. 3, 4 and 5 are sectional view on an enlarged scale taken along lines 3—3, 4—4 and 5—5 of FIG. 1, respectively;

FIG. 6 is a view like that of FIG. 3 showing an alternative embodiment of the present invention;

FIG. 7 is a view like that of FIG. 1 of a downwardly opening gate mechanism embodying the present invention;

FIG. 8 is a side view in elevation of the embodiment shown in FIG. 7; and FIG. 9 is a sectional view on an enlarged scale taken along line 9—9 of FIG. 7.

DETAILED DESCRIPTION OF THE PREFERRED EMBODIMENT

Figure 2:
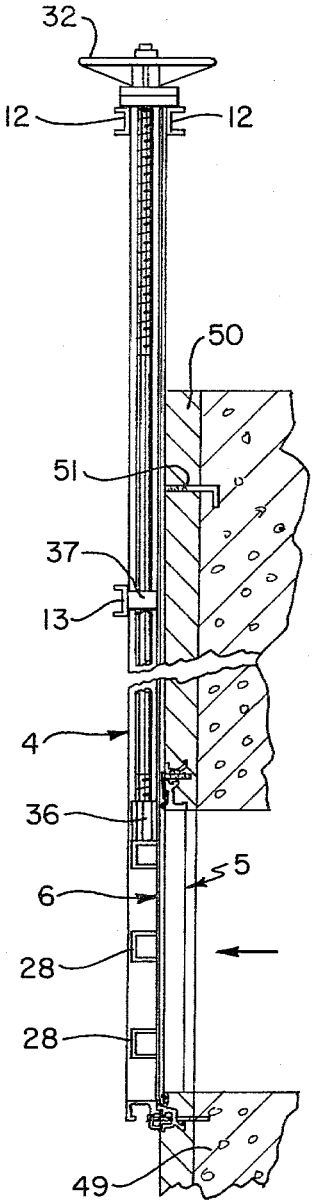
FIG. 2 is a side view in elevation of the embodiment shown in FIG. 1.

Referring first to FIGS. 1 and 2, there is shown a slide gate constructed in accordance with the present invention. The slide gate generally comprises a frame assembly comprised of a front frame subassembly 4 and a rear frame subassembly 5, a gate sliding member 6 and an operating means 8.

Front frame subassembly 4 is comprised of a pair of side gate guides 10, a pair of top yoke members 12, a stem guide support member 13 and an invert bottom member 14. Each of the side gate guides 10 is provided with a flange 16 (FIG. 3) on its front side and interrupted flat surfaces 18A and 18B separated by a groove 19 on its rear side. Top yoke members 12 are fixed to the tops of side gate guides 10 at a right angle, with one yoke member 12 running between and secured to the flanges 16 and the other yoke member 12 running between and attached to the interrupted surfaces 18A and 18B. Top yoke members 12 are preferably welded to side gate guides 10, though other known means of rigid attachment may be used. The stem guide support member 13 spans the two flanges 16 of side gate guides 10 and is secured thereto at right angles. Stem guide support member 13 is also preferably welded on. The bottom ends of side gate guides 10 are spanned by the invert member 4. Invert member 14 is set at a right angle to the gate guides 10 and is welded to those guides. Alternatively invert member 14 may be a separate member separately attached to the rear frame subassembly in the manner hereinafter described. In any event, side gate guides 10, top yoke members 12 and stem guide support member 13 combine to form a structurally rigid front frame subassembly 4.

Each of the gate guides is formed with a large groove 21 which runs for the full length of the frame and is oriented so that its open side is displaced 90° from the open side of groove 19. Disposed within each groove are two mutually spaced resilient bearing members 23 which may but need not be made of an elastomeric material. Preferably they are made of a plastic material having a relatively low coefficient of friction, e.g., ultra high molecular weight polyethylene (also known as UMHW). Each bearing 23 preferably extends along the entire length of a side gate guide 10, though in any case it extends along at least the bottom three quarters of the gate guide. Bearings 23 may be cemented to the side gate guides 10 to hold them in place. Preferably, however, each bearing 23 is formed with a dovetail rib 24 which fits within and makes a locking connection with a complementary groove 24 formed in the base of each groove 21. Each pair of bearings 23 has a flat mutually confronting and spaced surfaces 25 and is relieved to form a lip 26. The invert member 14 has the same cross-sectional shape as each of the side guides 10 and disposed within its groove 21 is a resilient gate stop 27. Gate stop 27 is preferably made of neoprene or some similar material and extends the entire length of member 14. Stop 27 is cemented in place but may have dovetail ribs 24 which lock in complementary grooves in members 14 as shown in FIG. 4.

Movably disposed within frame subassembly 4 is the gate member 6. Gate member 6 comprises a flat metal plate 30 whose opposite side margins are slidably received in the grooves between adjacent bearings 23 as shown in FIG. 3, so that gate member 6 may move vertically within frame subassembly 4. In its lowest position within the frame subassembly, gate member 6 rests on the resilient gate stop 27 (FIG. 4) set in invert member 14. A plurality of stiffener elements 28 are preferably welded to the front side of plate 30 so as to give the gate member greater structural integrity. Stiffeners 28 are sized so that they will not contact side gate guides 10 as gate 6 moves vertically within the frame subassembly 4.

The operating means 8 for moving gate 6 vertically relative to frame subassembly 4 comprises a handwheel 32 connected to a nut (not shown) journalled for rotation in a housing 34. Housing 34 is mounted to top yoke members 12. A threaded spindle or stem 35 extends through the nut in housing 34 and up through the handwheel 32. Spindle 34 also passes through a spindle guide 37 mounted to the stem guide support member 13, and is secured at its lower end to the gate member 6 by means of a connector 36. Connector 36 is mounted to gate 6 and the uppermost stiffener element 28 (FIGS. 1 and 5) by welding or other suitable means of attachment. Thus, by manually turning handwheel 30 in one direction the gate member 6 can be raised upwards within the frame subassembly 4, and by turning the handwheel in the opposite second direction the gate member 6 can be lowered within the frame subassembly to any selected height or until the bottom of gate member 6 engages gate stop 27. It is to be appreciated that the front frame subassembly 4, gate member 6 and operating means 8 form a discrete subassembly which can be removed without having to disturb the rear frame subassembly.

Referring now to FIGS. 2–5, the rear frame assembly 5 is intended to be mounted about a discharge opening 48 in a concrete wall 49 which may be a dam or a side wall in a concrete basin, holding tank or lagoon. The rear frame subassembly 5 generally comprises a pair of mutually spaced side thimbles 42 (FIG. 3), an extended bottom thimble 44 (FIG. 4) and an extended upper thimble 46 (FIG. 5). Thimbles 42 sit parallel to one another in a vertical direction and are joined at right angles to thimbles 44 and 46, with the latter two thimbles running between the inner edges of thimbles 42. In this way an interior opening is defined between thimbles 42, 44 and 46. The thimble members are joined to one another in this position by welding so that their common joints are sealed to make them watertight. The interior opening defined by frame subassembly 5 is sized so as to completely surround the opening 48. The thimbles 42, 44 and 46 of subassembly 5 are embedded in grouting 50 attached to the face of concrete wall 49, in the manner shown in FIGS. 2–5, whereby the rear frame subassembly 5 forms a rigid watertight extension of the concrete wall 49 about discharge opening 48. Although the interior opening formed by the rear frame subassembly 5 is sized only slightly larger than the wall opening 48, the side thimbles 42 may be sized to extend to substantially above the opening 48 in wall 49, e.g., to the top of the wall, in order to provide for further points of attachment of the side thimbles to wall 49 by means of anchor bolts 51 (FIGS. 1 and 2).

The four thimbles which make up the rear frame subassembly have the same cross-sectional configuration, each comprising a channel-shaped base portion made up of side flanges 52 and 54 and an intervening web 56 plus a second web 58 connected to web 56 by a pair of wall sections 60 and 62, and a pair of ribs 64 and 66 formed integral with web 56. The web 58 has a flat front surface, whereby a tight uniform engagement is made by the side and bottom thimbles 42 and 44 with the rear surfaces 18A and 18B of side guides 10 and invert 14 when the front and rear frame subassemblies are brought together. Webs 56 and 58 are formed with a number of aligned openings 65 and 67 at selected locations along the length of all four thimbles 42, 44 and 46 to accommodate mounting bolts 68 which are provided to facilitate attachment of the two frame subassemblies. The mounting bolts 68 are securely embedded in concrete wall 49 and extend outward through grouting 50 and thimble openings 65 and 67 and correspondingly located openings 70 formed in side gate guides 10, invert member 14 and a retaining plate 72 which engages the front surface of the web 58 of top thimble member 46. Nuts 74 are secured onto the bolts to releasably secure frame subassembly 4 to frame subassembly 5.

Captivated between each thimble 42 and its adjacent side gate guide 10 is a resilient seal 76A. Like seals 76B and C are captivated between the lower thimble 44 and invert 14 and the upper thimble 46 and retaining plate 72 (FIGS. 3–5). Seal 76A may run the entire length of thimbles 42, but preferably they extend along thimble 42 for the full distance between the thimbles 44 and 46. Seals 76B and C extend fully between the two side thimbles 42. Seals 76A–C serve to provide a watertight seal between the side, bottom and top portions of gate member 6 and its surrounding frame assembly 2 when the gate is in closed position, and additionally serves to prevent any fluid leakage between the side thimbles 42 and side gate guides 10 regardless of whether the gate member is open or closed. Seals 76A–C are formed of a water-insoluble resilient material, preferably neoprene, and each comprises a flat base portion 80 with an enlargement 82 at one end, a right angle neck portion 84 and a bulb portion 86 offset from the base portion of neck 84. When each seal 76A–C is properly positioned, its enlargement 82 fits between and engages the front surface of web 56, an end surface of web 58, and a side surface of rib 64, its base portion 80 extends parallel to the front surface of rib 64, its neck portion extends parallel to rib 66, and its bulb portion 86 is spaced from rib 66. Seals 76A–C are made so that their bulb portions 86 are offset from their base portions 80 by an amount sufficient for them to intrude into the space which forms an extension of the space between bearings 23 and is normally occupied by a portion of the gate, whereby when the front frame subassembly 4 with the gate is attached to the rear gate assembly 5, the gate will engage the bulb portions of side seals 76A, bottom seal 76B and top seal 76C, and force them back toward webs 56 and rubs 66, with the base portion 80 of each seal bending back around rib 64 as shown in FIGS. 3–5. The bent base portions will act as a spring to keep the bulb portions tight against the gate so as to provide an effective water-tight seal.

Since the direction of water flow is parallel to ribs 64 and 66, sediment will not tend to build up between the seals 76A–C and the thimbles or between the seals and side guides 10, yoke 14 or retainer 72. Also the exposed surface area of each seal 76A–C facing the adjacent thimble is greater than the exposed surface area of the front side of each seal, with the result that the water pressure upstream of the gate urges the seals toward instead of away from the gate.

Since the neck portion of the seals 76A–C are free to bend, the bulb portions 86 suffer substantially little or no deformation as a result of their contact with the sliding gate member 6, thereby assuring that substantially the total contact area of the seal at each side of the gate remains the same and is predictable to the extent required to determine the amount of force required to overcome the drag exerted on the gate by the seals. The extent to which the base portions 80 of the seals are compressed by tightening nuts 74 is limited by engagement of the surfaces 18A and 18B with webs 58 of the thimbles.

It is to be appreciated that the thimbles 42, 44 and 46 may be embedded directly into the concrete wall 49 instead of being secured thereto by grouting 50.

FIG. 6 illustrates a modification of the thimbles which may be used advantageously when the thimbles are secured in place without grouting and anchor bolts. In this case the thimble identified as 42A is the same as thimbles 42, 44 and 46 except that hole 65 is omitted from web 56 and holes 67 are replaced by a single continuous slot 67A that extends to at least the top and/or bottom end of thimble 42. As a further alternative slot 67A may be replaced by openings 67B (FIG. 1) that are elongated along the length of the thimble for an amount substantially in excess of the diameter of bolt 68A, e.g., 2–3 times greater in the manner suggested in dotted lines in FIG. 1, or else two or more of the openings 67B are extended so as to intersect one another and form an even more elongated opening or slot. Associated with each thimble are several tie-bolts 68A or studs which have affixed nuts 90 riding in the groove formed between walls 60 and 62. Additional nuts 74 are applied to tie bolts 68A to lock a side guide 10 to thimble 42 (or member 14 and 72 to thimbles 44 and 46 respectively). With this arrangement, the position of holes 70 along the length of side guide 10 is not critical since the slot 67A or the elongated openings 67B allow the tie-bolts to be moved vertically for alignment with holes 170. If openings 67B are replaced by a slot that goes to the upper and/or lower end of the thimbles, the nuts 90 may be assembled to the tie-bolts before the latter are fitted to the thimbles and the nuts may be replaced by heads or flanges formed integral with the tie-bolts. Providing thimbles as shown in FIG. 6 in place of any of the thimbles 42, 44 and 46 facilitates attachment of the gate assembly by direct embedding in concrete.

FIGS. 7–9 show how the invention may be used in a downwardly opening gate assembly. In this case rear frame sub-assembly 5 is the same as corresponding sub-assembly of FIGS. 1–5 except that in place of yoke member 14 the lower thimble 44A carries a seal retainer plate 72A corresponding in function to retainer plate 72. Thimble 44A is set in grouting 50 and nuts 74 on anchor bolts 68 further secure the thimble in place relative to concrete wall 49. The upper part of the rear frame sub-assembly may consist of a yoke member (not shown) extending between the two side thimbles 42A to hold them fixed in parallel relation to one another. Preferably, however, the thimbles 42A are held fixed by grouting 50 and also by anchor bolts 68 which are embedded in the concrete wall and coact with nuts 74 to hold the front frame sub-assembly 4 in place.

The front frame assembly 4 consists of two side gate guides 10 which extend substantially below the bottom of opening 48 and are secured together at the bottom end by a yoke member 12. Although not shown it is to be understood that gate sliding member 6 has the opposite side edges of its slide plate 30 slidably engaged between bearings 23 carried by the two side gate guides 10 and seals corresponding to seals 76A are mounted between the side thimbles 42A and side gate guides 10 and are engaged and deflected by slide plate 30 in the manner shown in FIG. 3 for seals 76A. The seal 76B carried by the bottom thimble 44A is shown in FIG. 9 in its undeflected state, i.e., without its being engaged by slide plate 30. When slide plate 30 is in its fully raised position, the bottom edge of slide plate 30 is in deflecting and sealed engagement with seal 76B.

In the embodiment of FIGS. 7–9, the operating means 8 has a shorter spindle 35 so that the gate member 6 may be moved from a top position where it fully closes off opening 48 and a bottom position (not shown) where the top edge of slide plate 30 is below the level of opening 48, whereby fluid can flow out of opening 48 without any impediment from the gate member.

Obviously the modification of FIG. 6 may be incorporated in the apparatus of FIGS. 7–9.

The advantages of the invention are that it provides better seals, is simple and less expensive to install, has a rugged construction and can be made in various sizes, can be installed with grouting or by embedding the rear frame directly in a concrete wall, and does not require any unique operating means or any unique supporting wall construction. Also the rear frame subassembly can be assembled at any convenient time to the supporting wall while the front frame subassembly and slide gate member may be mounted in place at another convenient time. Having movable fasteners with nuts 90 as heads as shown in FIG. 6 facilitates attachment of the front frame assembly and also avoids damage to the fasteners as frequently occurs to anchor bolts between the time they are embedded in the concrete and the time the gate mechanism is installed. Also damaged studs 68A can be easily replaced. A further advantage of the invention is that the improved seals may be used in assemblies other than exactly as herein shown and described, e.g., assemblies that have means other than resilient members 23 for slidably guiding the slide. The invention offers the further advantage of providing a predictable seal-to-slide frame fit, thereby avoiding critical fitting techniques at assembly, whether on site or at the factory. The rear frame assembly can also be mounted in two different ways as shown in FIGS. 5 and 6.

What is claimed is:

1. A slide gate mechanism adapted for mounting in functional relation with an opening in a wall, said gate comprising a rear frame assembly having first and second frame members for disposition along the sides of said opening and at least a third frame member extending between said first and second members for disposition along the bottom of said opening, a front frame assembly having first and second gate guide members for disposition along said first and second frame members and at least a fourth member extending between and interconnecting said first and second gate guide members, a gate assembly located between said first and second gate guide members, means associated with said first and second gate guide members for slidably engaging opposite edges of said gate assembly so that said gate assembly may be moved relative and parallel to said first and second gate guide members, and operating means carried by said front frame assembly and connected to said gate assembly and operable to selectively move said gate assembly in one direction or an opposite direction relative to said gate guide means so that said gate may be disposed in blocking or unblocking relation with said opening, and at least one resilient seal supported by at least one of said first, second and third frame members and slidably engaging said gate assembly, said at least one seal being disposed and constructed so that a first portion thereof is engaged by said gate assembly and a second portion thereof is deflected away from said gate assembly when said first portion thereof is engaged by said gate assembly.

2. A slide gate mechanism according to claim 1 wherein said front frame assembly is secured to said rear frame assembly by a plurality of threaded fasteners with each of said fasteners being movably mounted to one of said front and rear frame assemblies.

3. A slide gate mechanism according to claim 2 wherein said fasteners are movably mounted in channels formed in said first and second frame members.

4. A slide gate mechanism according to claim 1 wherein a separate resilient seal is supported by each of said first and second frame members, and further wherein each of said first and second frame members comprises a recess, a predetermined portion of each of said seals is disposed in the said recess of the frame member which supports said seal, and said first and second gate guide members are engaged with said predetermined portions of said seals and maintain said predetermined portions in said recesses.

5. A slide gate mechanism according to claim 1 wherein a separate resilient seal is supported by each of said first, second and third frame members, with each of said first, second and third frame members having means for engaging a selected portion of the seal which it supports, and further wherein each of said seals comprises another portion which is offset from the frame member which supports it and includes an enlarged portion which is engaged by said gate.

6. A slide gate mechanism according to claim 1 wherein each of said first and second gate guide members is provided with a groove, and further wherein said means for slidably engaging opposite edges of said gate assembly comprises first and second bearing members disposed within said groove and engaging opposite surfaces of said gate assembly.

7. A slide gate mechanism according to claim 1 wherein said front frame assembly is secured to said rear frame assembly by a plurality of fasteners which extend through said rear frame assembly and are provided with threaded portions that extend through said front frame assembly, and further including a nut secured on the threaded portion on each of said fasteners in position to maintain said front frame assembly in tight engaging relation with said rear frame assembly.

8. A slide gate mechanism according to claim 1 wherein said at least one resilient seal comprises a base portion, an enlargement on said base portion in engagement with said rear frame assembly, and a bulb portion on said base portion projecting away from said rear frame assembly, said bulb portion being disposed so as to be deflected by said gate assembly in the direction of said rear frame assembly, whereby said bulb portion makes an intimate sliding engagement with said gate assembly.

9. A slide gate mechanism according to claim 8 having at least two of said seals, with one of said seals being supported by said first frame member and the other being supported by said second frame member.

10. A slide gate mechanism according to claim 9 having a third seal supported by said third frame member.

11. A slide gate mechanism adapted for mounting in functional relation with an opening in a wall, said gate comprising a rear frame assembly having first and second side frame members for disposition along the sides of said opening, a front frame assembly having first and second gate guide members for disposition along said first and second side frame members and at least a third member extending between and interconnecting said first and second gate guide members, a gate assembly located between said first and second gate guide members, means associated with said first and second gate guide members for slidably engaging opposite edges of said gate assembly so that said gate assembly may be moved relative and parallel to said first and second gate guide members and disposed in blocking or unblocking relation with said opening, and first and second resilient seals supported by said first and second frame members and slidably engaging said gate assembly, each of said seals being disposed and constructed so that a first portion thereof is engaged by said gate assembly and a second portion thereof is deflected away from said gate assembly when said first portion is engaged by said gate assembly.

12. A slide gate mechanism according to claim 11 wherein each of said resilient seals comprises a base portion, an enlargement on said base portion in engagement with said rear frame assembly, and a bulb portion on said base portion projecting away from said rear frame assembly, said bulb portion being disposed so as to be deflected by said gate assembly in the direction of said rear frame assembly, whereby said bulb portion makes an intimate sliding engagement with said gate assembly.

* * * * *